United States Patent [19]

Gaskin

[11] Patent Number: 4,838,212

[45] Date of Patent: Jun. 13, 1989

[54] SUPERHEATER UNIT OF A STEAM GENERATING SYSTEM

[75] Inventor: Matthew J. Gaskin, Williston Park, N.Y.

[73] Assignee: Morse Boulger, Inc., Long Island, N.Y.

[21] Appl. No.: 256,260

[22] Filed: Oct. 12, 1988

Related U.S. Application Data

[63] Continuation of Ser. No. 915,012, Oct. 3, 1986, abandoned.

[51] Int. Cl.[4] ..... F23B 37/52

[52] U.S. Cl. ..... 122/392; 122/235 C; 122/476

[58] Field of Search ..... 122/235 R, 235 A, 235 C, 122/235 F, 235 K, 235 L, 273, 327, 328, 338, 343, 347, 351, 352, 379, 390, 392, 393, 405, 460, 468, 473, 476, 477, 478, 511, DIG. 13

[56] References Cited

U.S. PATENT DOCUMENTS

| | | | |
|---|---|---|---|
| 1,791,064 | 2/1931 | Murray | 122/235 A |
| 1,884,741 | 10/1932 | Kleffel | 122/235 C |
| 2,234,222 | 3/1941 | Baerer | 122/392 |
| 2,368,633 | 2/1945 | Blizard | 122/473 |
| 2,764,137 | 9/1956 | Koch | 122/478 |
| 2,851,017 | 9/1958 | Blaskowski | 122/476 |
| 3,003,482 | 10/1961 | Hamilton et al. | 122/478 |
| 3,101,698 | 8/1963 | Kochey, Jr. | 122/476 X |
| 4,033,297 | 7/1977 | Moreau | 122/476 |
| 4,617,988 | 10/1986 | Kohnen et al. | 122/392 X |

*Primary Examiner*—Steven E. Warner
*Attorney, Agent, or Firm*—Lalos & Keegan

[57] ABSTRACT

A tube assembly for superheater unit of a steam generating system comprising a bank of superheater tubes rigidly secured together and a screen tube adapted to be connected to a source of coolant disposed adjacent the length of and attached to an end tube of the bank of superheater tubes.

7 Claims, 2 Drawing Sheets

SUPERHEATER UNIT OF A STEAM GENERATING SYSTEM

This is a continuation of copending application Ser. No. 915,012 filed on Oct. 3, 1986 now abandoned.

This invention relates to an improvement in a steam generating system and more particularly to an improvement in a superheater unit of such a system.

During operation of boilers of refuse fired steam generating systems used to drive steam turbines, the rows of tubes of the superheater unit continuously are subjected to boiler flue gases. Such gases contain chloride and sulfide due to the nature of the refuse fuel. The impingement of such high temperature and high velocity gases on the superheater tubes results in the erosion and corrosion of the tubes and their early failure. The deposit of soot on the tubes reduces the heat exchange efficiency of the unit. Normally, the accumulation of soot on the tubes is periodically removed by the use of soot blowers which inject jets of steam between rows of tubes to dislodge the accumulated soot.

The problem of the erosive and corrosive effects of flue gases in boilers utilizing refuse or refuse-derived fuels is exacerbated by the chloride, sulfide and abrasive fly ash content of the gases. In some instances, such problem has been addressed by enlarging the furnaces of such systems to reduce flue gas exit temperatures and gas velocities. Although such design changes have resulted in reduced corrosion and erosion, it has not entirely eliminated such conditions and further has resulted in increased construction and maintenance costs.

The problem of the deleterious effects of flue gases also has been addressed by coating the tubes of the superheater unit with a refractory material such as silicon carbide. While such coatings have been found to be effective in protecting the steam generating tubes, they further have had the result of reducing gas passages, increasing gas velocities in certain areas, reducing heat transfer and increasing erosion of boiler screen tubes. Furthermore, it has been found that the impingement of high velocity injections of steam from soot blowers has had a tendency to damage and dislodge the refractory coatings on the superheater tubes thus exposing the tubes to the deleterious effects of the flue gases.

Accordingly, it is the principal object of the present invention to provide an improved steam generating system suitable for driving a steam turbine.

A further object of the present invention is to provide an improved steam generating system capable of generating steam at turbine design temperatures and pressures.

A still further object of the present invention is to provide an improved superheater unit for a steam generating system.

Another object of the present invention is to provide an improved superheater unit for a steam generating system which s subjected to erosive and corrosive flue gases.

A further object of the present invention is to provide an improved superheater unit for a steam generating system which utilizes refuse or refuse-derived fuels containing erosive and corrosive elements such as chlorides, sulfides and abrasive fly ash.

A still further object of the present invention is to provide an improved superheater unit for a steam generating system in which the tubes of the unit are protected from the deleterious erosive and corrosive effects of the boiler flue gases and the harmful effects of blowers utilized to remove soot deposited on such tubes.

Another object of the present invention is to provide an improved superheater unit for a steam generating systems which is simple in design, effective in performance and easy to service and maintain.

Other objects and advantages of the present invention will become more apparent to those persons having ordinary skill in the art to which the present invention pertains from the following description taken in conjunction with the accompanying drawings, in which:

Figure 1:
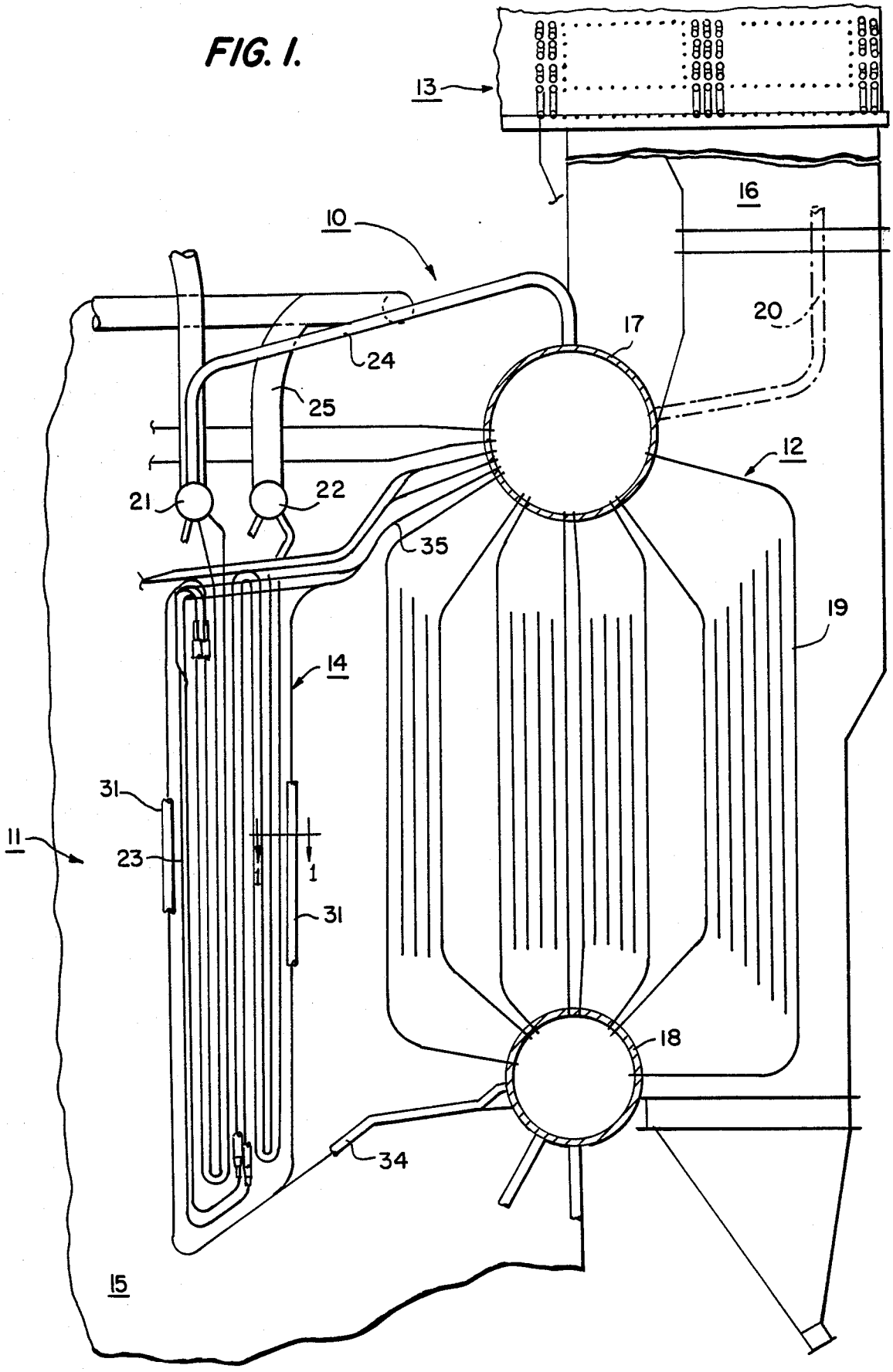
FIG. 1 is a side elevational view of a steam generating system embodying the present invention, having portions thereof depicted diagrammatically.

Referring to the drawings, there is illustrated a boiler unit 10 which utilizes a refuse or refuse-derived fuel to generate steam for driving a turbine. The unit includes a housing 11, a primary steam generating unit 12, an economizer 13 and a superheater unit 14. The boiler furnace includes side, top and bottom walls defining a combustion chamber 15. Although not shown, refuse or refuse-derived fuel is adapted to be charged into the combustion chamber by feeder devices which deposit the fuel on a grate at the lower end of the chamber. The fuel is provided with primary and secondary combustion air and burned on the grate and in suspension within the furnace. The hot gases emanating from the burning refuse will be caused to flow upwardly past the superheater unit and the primary steam generating unit, and through the flue 16 from where they are discharged into the atmosphere or otherwise treated prior to being discharged into the atmosphere.

The primary steam generating unit includes an elevated steam drum 17, a lower mud drum 18 and a plurality of interconnecting downcomer and riser tubes 19. Feedwater preheated by economizer 13 is supplied in the conventional manner to the steam drum though a supply conduit 20.

Superheater unit 14 is disposed substantially between the fuel supporting grate and primary steam generating unit 12 and consists of an inlet header 21, an outlet header 22 and a plurality of depending superheater tubes 23 interconnecting the inlet and outlet headers. The various banks of superheater tubes are supported by the inlet and outlet headers which are in turn supported by structural steel members similar to the members which normally support the furnace roof and wall sections. Saturated steam in steam drum 17 is conducted to inlet header 21 by means of an inlet conduit 24. From the inlet header, the saturated steam flows through the superheater tubes, becoming superheated, and into outlet header 22. The superheated steam then is conducted through an outlet conduit 25 and a boiler main stop valve to the steam turbine.

Figure 2:
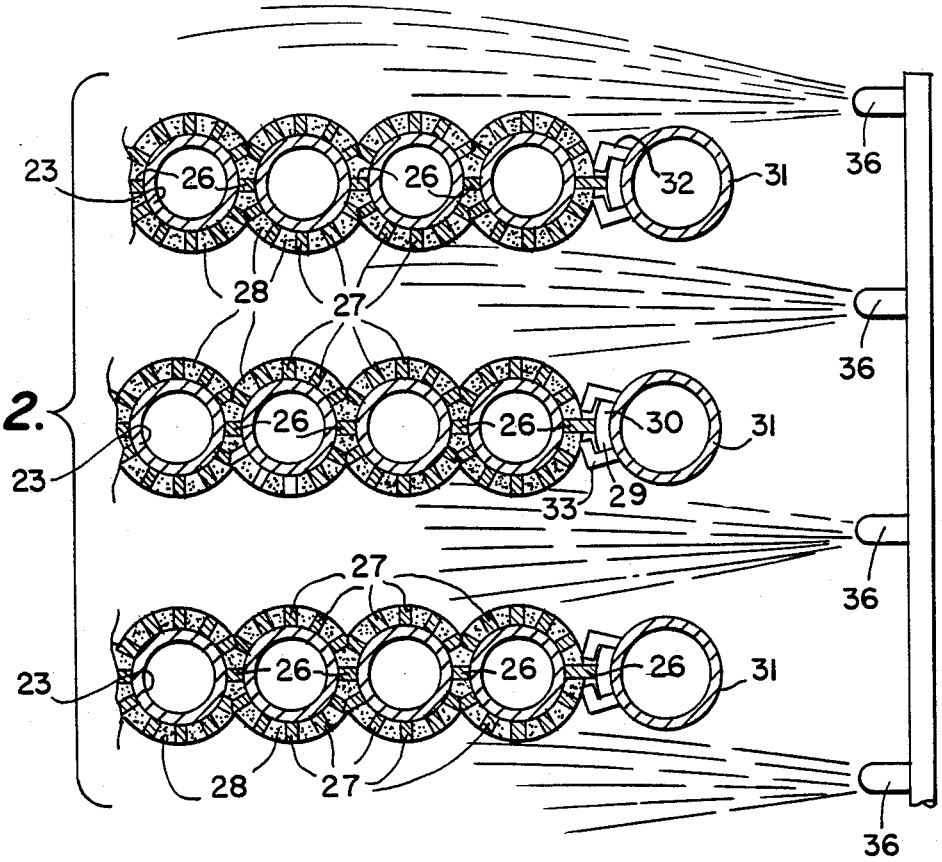
FIG. 2 is an enlarged cross-sectional view taken along line 1—1 in FIG. 1.
Figure 3:
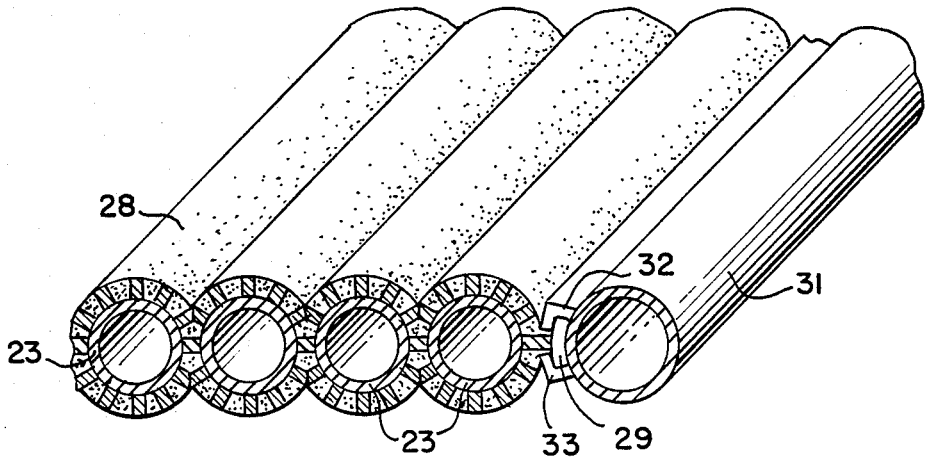
FIG. 3 is a perspective view of a bank of superheater tubes as shown in FIG. 2.

As best shown in FIGS. 2 and 3, successive tubes of each bank of superheater tubes are rigidly interconnected by rigid membranes or links 26 to form a sturdy panel of tubes. Each of the tubes are provided with a plurality of studs 27 which are formed on the outer surfaces of the tubes. The tubes are coated with a refractory material 28 which embeds not only tubes 23 but connecting membranes 26 and studs 27.

The end membrane on each bank of superheater tubes is provided with a rigidly secured cap element 29 which cooperates with the adjoining membrane to form a T-shaped mounting member 30. Detachably mounted to each end tube of each bank of superheater tubes is a screen tube 31 which is provided with a set of L-shaped clip elements 32 and 33 which cooperate with a T-shaped element 30 to clip the screen tube onto the end of a bank of superheater tubes. As best shown in FIG. 1, screen tubes 31 are connected through a supply conduits 34 to the lower end of steam drum 17. Water from mud drum 17 is caused to flow through supply conduit 34, screen tubes 31 and return tubes 35 to cool the screen tubes.

Superheater tubes 23 are formed of a suitable steel and are interconnected by steel membranes welded to the tubes. Studs 27 similarly are formed of a suitable steel and also are welded to the outer surfaces of tubes 23. Each of the screen tubes also is formed of a suitable steel and has a diameter slightly larger than the diameter of a superheater tube. As best shown in FIG. 2, the screen tubes positioned at the ends of the banks of superheater tubes are disposed between a soot blower 35 and the banks of superheater tubes so that when the soot blower is operated and injects a stream of high temperature steam at high velocities between the banks of superheater tubes, the screen tubes will shield the banks of superheater tubes from direct impingement of the steam jets.

In the normal operation of the system as described, water in the steam drum will flow downwardly through the downcomer tubes of the primary steam generating unit, saturated steam will form from the heated water and the saturated steam will rise in the riser tubes back into the steam drum. Saturated steam in the steam drum will then flow through supply conduit 24 into inlet header 21 and through the superheater tubes to outlet header 22 from where superheated steam is conducted to the steam turbine through the main stop valve. Since the superheater unit is disposed closer to the burning refuse, high temperature flue gases at high velocities emanating from the burning refuse will flow through the superheater unit impinging upon the banks of superheater tubes. The coating of refractory material on the banks of the superheater tubes prevents the direct contact of the flue gases with the metallic superheater tubes which otherwise would cause corrosion and erosion of the tubes over a period of operation. A certain amount of residue, however, will be deposited on the banks of superheater tubes which, if not removed, will reduce the heat exchange efficiency of the superheater unit.

To dislodge and remove the soot deposited on the banks of the superheater tubes by the flue gases emanating from the burning refuse, soot blowers 35 are provided in the walls of the housing. Each soot blower includes a manifold connected to a source of high temperature steam under pressure, which injects high temperature steam at high velocities through a set of nozzles 36 toward and between the banks of the superheater tubes. Direct impingement of the streams of high temperature steam with the refractory coating at the ends of the banks of tubes is prevented by screen tubes 31. However, the streams of steam injected between the banks of superheater tubes function to dislodge and remove the soot deposited on the refractory coatings. The screening of the ends of the banks of superheater tubes by screen tubes 31 prevents damage and eventual deterioration of the refractory coating on the ends of the banks of superheater tubes which would have the effect of exposing the superheater tubes to the deleterious effects of the flue gases. The screen tubes are cooled by water circulated through the tubes from the mud drum.

During normal operating conditions, the refractory material encasing the superheater tubes is heated to a temperature in the order of 1400° F. The temperature of the steam injected between the banks of superheated tubes normally is in the order of 700° F. Without the screen tubes, in which water at a temperature of 450° is circulated, shielding the higher temperature refractory material, the impingement of the soot blowing steam on the refractory material would result in thermal shock, accelerating their deterioration.

Since the section of superheater tubes 23 and screen tubes 31 disposed nearest the burning refuse, usually referred to as the "bull nose" section of the superheater, are subjected to extremely high temperature and velocity gases emanating from the combustion zone of the system, such tubes including the screen tubes preferably are encased in a refractory to prevent erosion of such tubes.

Screen tubes not provided with any protective coating will deteriorate after a certain period in service. However, they can be replaced during normal shutdown periods for maintenance. Such tubes may easily be detached from the superheater tube banks and replaced with new screen tubes. The clip-on arrangement of the screen tubes facilitates such replacement.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. In a stream generating system utilizing refuse as a fuel, having a furnace for incinerating said refuse, a primary steam generating unit communicating with said furnace, a superheater unit disposed between said furnace and said primary steam generating unit, said superheater unit including a plurality of banks of tubes lined with a refractory material for shielding said superheater tubes from the harmful effects of corrosive gases and abrasive particles generated by the burning refuse, and soot blowing means operable for injecting a spray of stream toward said refractory lined superheater tubes for dislodging soot deposited thereon, the improvement comprising at least one screen tube connected to a source of coolant, disposed between said soot blowing means and an end tube of a bank of superheater tubes for shielding said bank of superheater tubes from direct impingement of the spray of steam infected by said soot blowing means.

2. The improvement according to claim 1 wherein said screen tube is connected to a source of coolant having a temperature lower than the temperature of the steam in the superheater tubes.

3. The improvement according to claim 1 wherein said screen tube is connected to a source of coolant having a temperature lower than the temperature of the soot blowing steam.

4. The improvement according to claim 1 wherein said screen tube is connected to a source of coolant consisting of water.

5. The improvement according to claim 1 wherein said screen tube is connected to a source of coolant having a temperature of substantially 450° F.

6. The improvement according to claim 1 wherein said screen tube is connected to a mud drum of said system.

7. The improvement according to claim 1 wherein said screen tube is detachably connected to said end tube of said bank of superheater tubes.

* * * * *

UNITED STATES PATENT AND TRADEMARK OFFICE

CERTIFICATE OF CORRECTION

PATENT NO. : 4,838,212

DATED : June 13, 1989

INVENTOR(S) : Matthew J. Gaskin

It is certified that error appears in the above-identified patent and that said Letters Patent is hereby corrected as shown below:

Column 1, line 58, delete "which s" and insert --which is--;

Column 4, lines 43 and 53, delete "stream" and insert --steam--;

Column 4, line 59, delete "infected" and insert --injected--.

Signed and Sealed this

Seventeenth Day of April, 1990

*Attest:*

*Attesting Officer*

HARRY F. MANBECK, JR.

*Commissioner of Patents and Trademarks*